US007413271B2

(12) United States Patent
Furuya et al.

(10) Patent No.: US 7,413,271 B2
(45) Date of Patent: Aug. 19, 2008

(54) INK JET SYSTEM

(75) Inventors: Masami Furuya, Ebina (JP); Jun Isozaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 258 days.

(21) Appl. No.: 11/059,102

(22) Filed: Feb. 16, 2005

(65) Prior Publication Data

US 2006/0055719 A1 Mar. 16, 2006

(30) Foreign Application Priority Data

Sep. 13, 2004 (JP) ..... 2004-265988

(51) Int. Cl.
*B41J 29/38* (2006.01)

(52) U.S. Cl. ..... 347/14; 347/16; 347/19

(58) Field of Classification Search ..... 347/14, 347/16, 19

See application file for complete search history.

(56) References Cited

U.S. PATENT DOCUMENTS 4,963,882 A * 10/1990 Hickman ..... 347/41
6,457,807 B1 * 10/2002 Hawkins et al. ..... 347/40
6,471,352 B2 * 10/2002 Akahira ..... 347/106
6,517,180 B2 * 2/2003 Tullis et al. ..... 347/19
6,565,180 B2 * 5/2003 Yu et al. ..... 347/19
6,644,772 B2 * 11/2003 Choi ..... 347/19
6,874,862 B2 * 4/2005 Shade ..... 347/40

FOREIGN PATENT DOCUMENTS

JP 09-066650 3/1997
JP 09-094950 4/1997
JP 2004-009474 1/2004

* cited by examiner

*Primary Examiner*—Thinh H Nguyen
(74) *Attorney, Agent, or Firm*—Fildes & Outland, P.C.

(57) ABSTRACT

An ink jet injection system performs detecting an ink injection condition by ejecting ink droplets so as to form a detecting pattern on a recording medium. When the detecting pattern is formed, the ink droplets are ejected at almost the same position in the state in which the transportation of the recording medium is stopped or a feeding speed of the recording medium is set slower than that during a normal printing operation.

3 Claims, 4 Drawing Sheets

INK JET SYSTEM

CROSS-REFERENCE TO RELATED APPLICATION

This application claims priority under 35 USC 119 from Japanese Patent Application No. 2004-265988, the disclosure of which is incorporated by reference herein.

BACKGROUND OF THE INVENTION

1. Technical Field

The present invention relates to a detecting pattern forming method for identifying a malfunctioning droplet injecting element and an ink jet recording apparatus capable of detecting an ink injection condition by ejecting ink droplets so as to form a detecting pattern on a recording medium.

2. Description of the Related Art

The maintenance of a quality of an image requires detecting the injection condition of an ink droplet in an ink jet, recovering the ink jet according to the condition, replacing a nozzle with another nozzle, making a blank inconspicuous by image processing, and the like.

Regarding this detection, several methods have been proposed for printing a printing pattern for detection so as to detect the printing pattern by an optical sensor.

In order to facilitate the detection of yellow ink whose visibility is low, for example, Japanese Patent Application Laid-Open (JP-A) No. 9-66650 discloses that yellow ink is printed and overlaid with ink of other colors to make a secondary color and the detection is performed with respect to the secondary color. A detecting sensor for color printing is required in this method, and the sensor raises production cost. Moreover, additional ink of colors other than yellow is needed to consume.

JP-A No. 9-94950 discloses that an image is independently printed at a visible position by avoiding adjacent printing in order to enhance the visibility of a pattern for printing examination. The degradation of the visibility is recognized in the case of ink having a low concentration such as yellow ink or a head of a high resolution with a small dot diameter.

JP-A No. 2004-9474 discloses that printing and detection are performed by shifting a printing nozzle. The degradation of detection sensitivity is recognized in the case of ink having a low concentration such as a yellow ink or a head of a high resolution with a small dot diameter.

In the prior art, in the case where a transparent liquid such as a treatment liquid for preventing any ink ooziness is ejected from a nozzle, a transparent printing pattern is formed, and such a transparent pattern is not detected by an optical sensor.

SUMMARY OF THE INVENTION

The present invention has been made in view of the above circumstances and provides a method of forming a test detecting pattern to identify a malfunctioning droplet element and an ink jet recording apparatus capable of detecting an ink injection condition by ejecting ink droplets so as to form a detecting pattern on a recording medium.

A first aspect of the invention relates to a method of forming a detecting pattern to identify a malfunctioning droplet injecting element. The method includes ejecting a plurality of ink droplets at almost identical position with transportation of a recording medium stopped.

A second aspect of the invention relates to a method of forming a detecting pattern to identify a malfunctioning droplet injecting element. The method includes setting a transporting speed of a recording medium lower than a speed during a normal printing operation, when the detecting pattern is formed.

A third aspect of the invention relates to a method of forming a detecting pattern to identify a malfunctioning droplet injecting element. The method includes ejecting a droplet of a liquid onto a recording medium whose color changes in accordance with adhesion of the liquid.

A fourth aspect of the invention relates to an ink jet recording apparatus capable of detecting an ink injection condition by ejecting ink droplets so as to form a detecting pattern on a recording medium. The ink jet recording apparatus has a feeding unit for feeding the recording medium, an ejecting element for ejecting the ink droplets onto the recording medium, and a controller for controlling driving of at least the feeding unit and the ejecting element. The controller controls driving of the feeding unit and the ejecting element in such a manner as to eject the ink droplets at almost identical position in a state in which the transportation of the recording medium is stopped, when the detecting pattern is formed.

A fifth aspect of the invention relates to an ink jet recording apparatus capable of detecting an ink injection condition by ejecting ink droplets onto a recording medium so as to form a detecting pattern on the recording medium. The ink jet recording apparatus has a unit for feeding the recording medium, an ejecting element for ejecting the ink droplets onto the recording medium, and a controller for controlling driving of at least the feeding unit and the ejecting element. The controller controls driving of the feeding unit in such a manner as to set a feeding speed of the recording medium lower than that during a normal printing operation when the detecting pattern is formed.

BRIEF DESCRIPTION OF THE DRAWINGS

Embodiments of the present invention will be described in detail based on the following figures.

DETAILED DESCRIPTION OF THE INVENTION

A description will be given below of embodiments according to the present invention in reference to the attached drawings.

Figure 1:
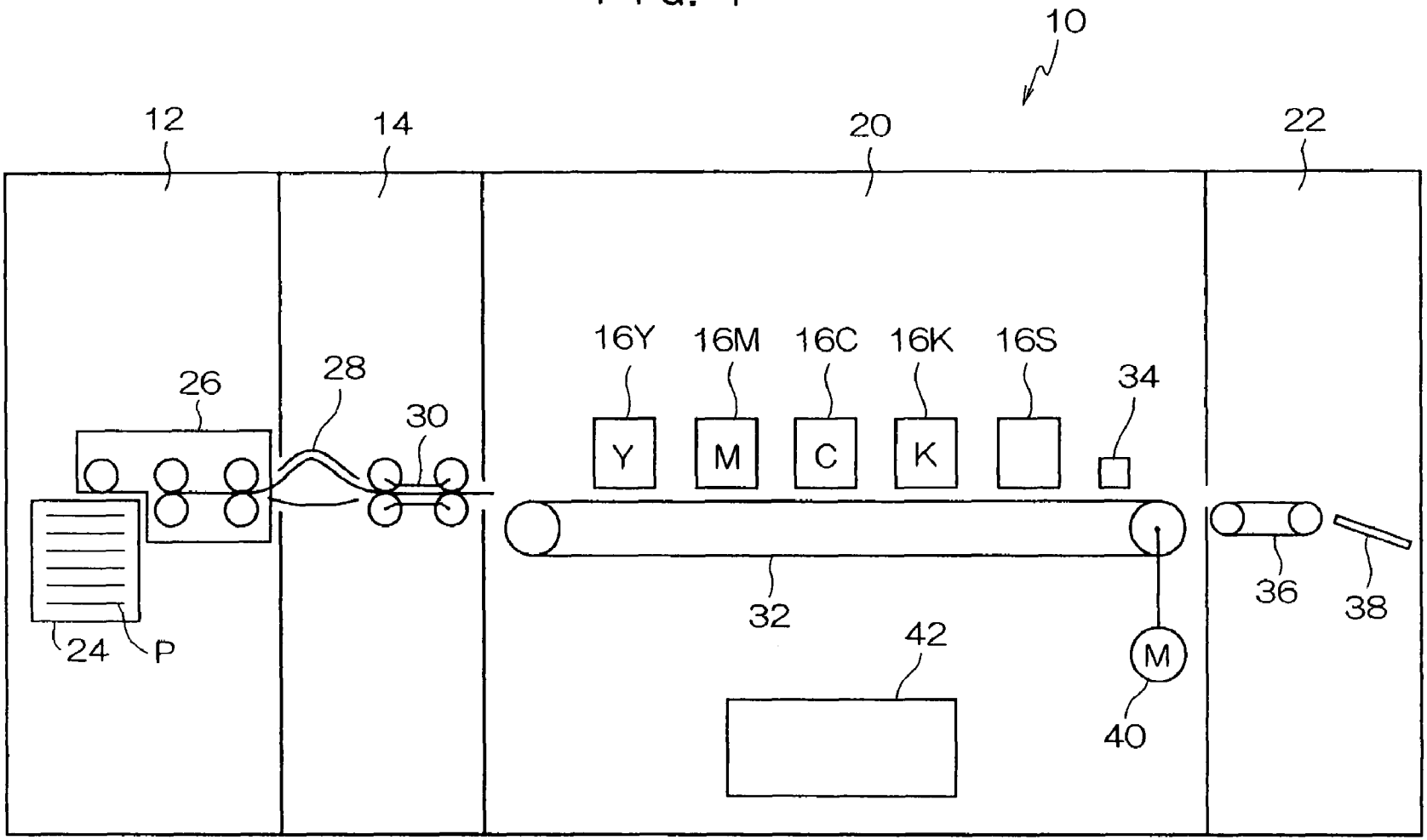
FIG. 1 is a diagram illustrating the schematic configuration of an ink jet recording apparatus.

As shown in FIG. 1, an ink jet recording apparatus 10 basically comprises a recording medium supplying unit 12 for feeding out a recording medium P, a registration adjustment unit 14 for controlling the orientation of the recording medium P, a recording unit 20 including recording head units 16Y, 16M, 16C and 16K for ejecting ink droplets so as to form an image on the recording medium P, and a discharging unit 22 for discharging the recording medium P, on which the image has been formed in the recording unit 20.

The recording medium supplying unit 12 includes a stocker 24, in which the recording mediums P are stocked in superimposition, and a feeder 26 for taking the recording mediums P one by one from the stocker 24 so as to feed the recording mediums P into the registration adjustment unit 14.

The registration adjustment unit 14 includes a loop forming unit 28 and a guide member 30 for controlling the orientation of the recording medium P. When the recording medium P passes through the registration adjustment unit 14, a skew is corrected by utilizing the strength of the recording medium P, and further, timing of transportation is controlled. Thereafter, the recording medium P proceeds into the recording unit 20.

The recording unit 20 includes a recording medium feeding belt 32 for feeding the recording medium P. Ink droplets are ejected from each of the recording head unit 16Y, 16M, 16C and 16K onto the recording mediums P, which are sequentially transported, thereby forming a color image on the recording medium P.

Each of the recording head units 16Y, 16M, 16C and 16K is a so-called ink jet recording head for ejecting the ink droplets from the nozzle.

A plurality of nozzles, not shown, for ejecting the ink droplets are arranged at predetermined intervals in a direction perpendicular to a feeding direction of a recording medium at the nozzle surface of each of the recording head units 16Y, 16M, 16C and 16K.

In each of the recording head units 16Y, 16M, 16C and 16K, the length of a nozzle array is set to a width dimension or more in a printing region of the recording medium P.

Incidentally, no consideration need be given to the kind of ink and an ink droplet ejecting system as long as each of the recording head units 16Y, 16M, 16C and 16K is of an ink jet system. Here, although the explanation has been made on the ink droplet ejecting system which is of an ink jet system, the type of system is not important as long as a colorant is directly transferred out of contact with the recording medium.

Although the ink jet system is typical, any system can be used as long as a system is publicly known.

In addition, the ink jet system is not limited to a thermal ink jet system, a piezoelectric ink jet system, a continuous flow ink jet system, an electrostatic attraction ink jet system and the like.

Furthermore, an aqueous-based ink, an oily ink, a gelled ink, a so-called solid ink which is solid at room temperature and a solvent ink can be used as the ink herein.

The colorant contained in the ink may be a pigment and a dye.

In the present embodiment, the recording head unit 16Y for ejecting a yellow (Y) ink droplet, the recording head unit 16M for ejecting a magenta (M) ink droplet, the recording head unit 16C for ejecting a cyan (C) ink droplet and the recording head unit 16K for ejecting a black (K) ink droplet are arranged in order along the transportation direction of a recording medium, thereby achieving full-color printing.

Here, a head unit 16S for ejecting a treatment liquid and a line sensor (for example, a CCD line sensor) 34 are disposed downstream of the recording head unit 16K in the conveyance direction of a recording medium.

In the discharging unit 22, the recording medium P, on which the image has been formed in the recording unit 20, is stacked on a tray 38 via a recording medium discharging belt 36.

Incidentally, the recording head units 16Y, 16M, 16C and 16K, the head unit 16S, a motor 40 for driving the recording medium feeding belt 32, the line sensor 34 and the like are connected to a controller 42.

Hereinafter, a description will be given of a method for determining as to whether or not the injection from the nozzle is normal in the ink jet recording apparatus 10 in the present embodiment.

Normally, a printing dot is injected in such a manner as to be landed at a position, at which the dots cannot overlap with each other, and thus, an image is formed.

For example, in the case where a printing operation is performed at a resolution of 600×600 dpi by a head having a resolution of 600 dpi, the printing can be performed at the resolution of 600×600 dpi by driving and feeding a recording medium at a speed of 20 inch/sec if the printing operation is performed at a head driving frequency of 12 kHz.

In the ink jet recording apparatus 10 in the present embodiment, it is determined as to whether or not an ink droplet is normally injected from the nozzle by detecting one dot line to be recorded in the transportation direction of a recording medium.

Figure 2A:
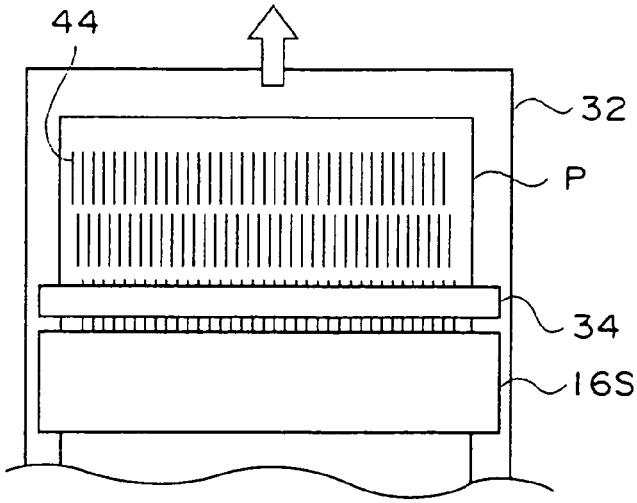
FIG. 2A is a plan view showing the apparatus and a recording medium in the state in which a non-ejection detecting pattern is recorded on the recording medium.

FIG. 2A illustrates the recording medium P having a non-ejection detecting pattern recorded thereon, the recording medium P passing under the line sensor 34.

Figure 2B:
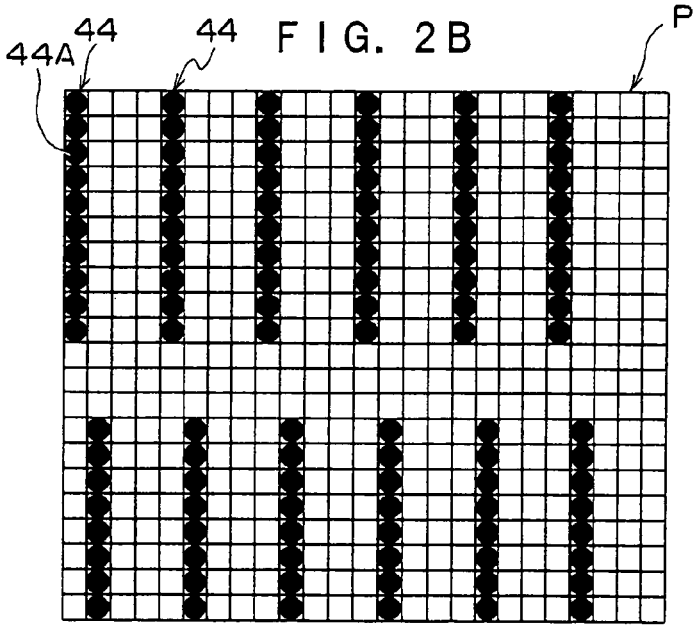
FIG. 2B is an enlarged view showing the non-ejection detecting pattern.

FIG. 2B is an enlarged view showing the non-ejection detecting pattern by the nozzle in the case of dense ink such as black ink. Incidentally, in FIG. 2B, a square matrix is depicted for the sake of easy understanding of a dot pitch, and therefore, it is not actually printed on the recording medium P.

Here, the ink droplets are ejected predetermined times (for example, ten times) at intervals of 4 nozzles, and thereafter, the ink droplets are ejected from an adjacent nozzle in the same manner. In this way, the same operation is repeated until the ink droplets are ejected from all of the nozzles.

The above-described recording medium P having the non-ejection detecting pattern formed thereon is transported under the line sensor 34 by the recording medium feeding belt 32. Thus, the line sensor 34 detects as to whether or not there is a dot line 44 having a plurality of dots 44A aligned in the transportation direction of a recording medium.

Here, because yellow ink, for example, is remarkably lower in concentration than the black ink, it is difficult to detect the dot line with high accuracy by means of the line sensor 34. As a consequence, in the case where it is determined as to whether or not the yellow ink droplet is normally injected in the present embodiment, a recording medium feeding speed is set to a half of a normal printing speed (for example, 10 inch/sec).

Figure 2D:
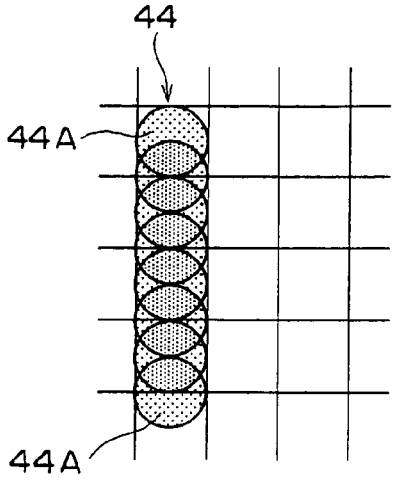
FIG. 2D is an enlarged view showing a dot line shown in FIG. 2C.
Figure 2C:
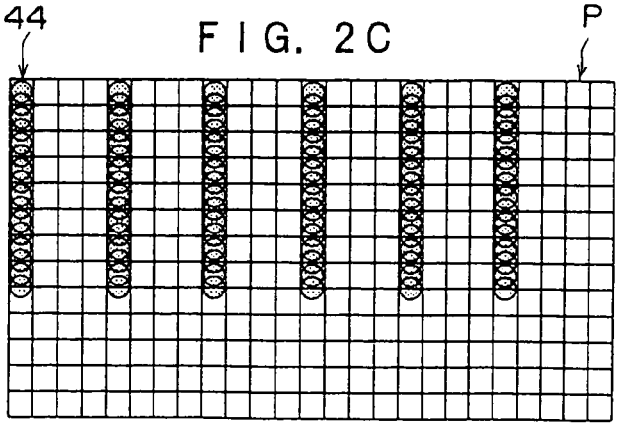
FIG. 2C is an enlarged view showing the non-ejection detecting pattern in the case of ink having a low concentration.

In this manner, as illustrated in FIGS. 2C and 2D, the yellow ink overlaps every half dots on the recording medium, so that the quantity of ink per unit area becomes twice, thereby increasing the concentration. Thus, it is possible to detect one dot line of the yellow ink by the line sensor 34 with high accuracy.

Figure 3A:
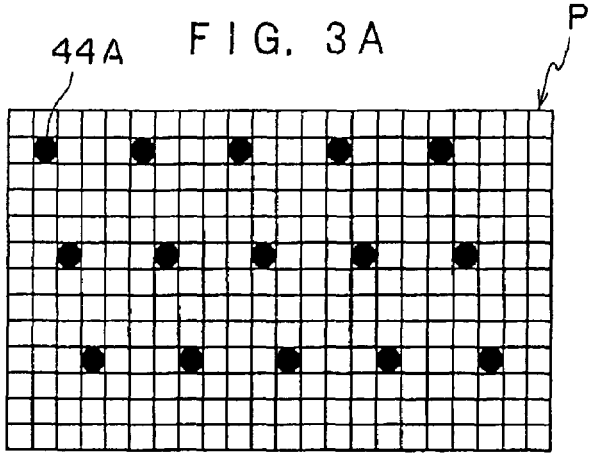
FIG. 3A is an enlarged view showing another non-ejection detecting pattern.

Although the dot line 44 consisting of the plurality of dots 44A is recorded and detected while the recording medium P is transported in the above-described embodiment, an ink droplet is injected by one dot at almost the same position in the state in which the transportation of the recording medium P is stopped in the case of the ink higher in concentration, as illustrated in FIG. 3A. Thereafter, the recording medium P is transported by such a distance as not to be adjacent to the injected dot (by the three dots, herein), and then, an ink droplet is injected by one dot from another nozzle. This operation may be repeated.

Figure 3B:
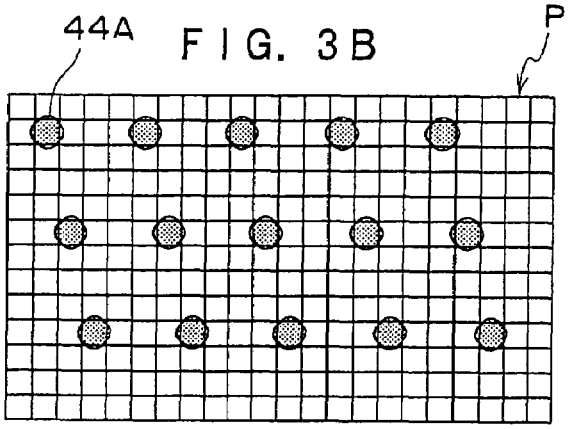
FIG. 3B is an enlarged view showing the non-ejection detecting pattern in the case of ink having a low concentration.

In the case of a small dot diameter or ink of low concentration, the quantity of ink per unit area is increased by injecting the plurality of dots at one and the same position from one and the same nozzle in the state in which the transportation of the recording medium P is stopped (see FIG. 3B). Consequently, the concentration of the dot 44A becomes higher, thereby enhancing a detection sensitivity by the line sensor 34.

Incidentally, the line sensor 34 merely detects the concentration of the ink on the recording medium P. Therefore, it may not be an expensive line sensor for color printing and may be an inexpensive line sensor for monochromatic printing. Further, accurate detection can be achieved even by a line sensor for a low resolution.

Figure 3C:
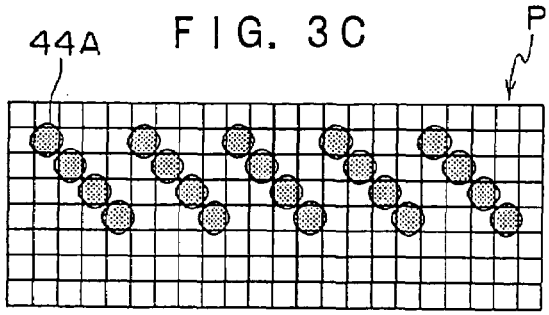
FIG. 3C is an enlarged view showing the non-ejection detecting pattern in the case where a feeding speed is reduced.
Figure 3D:
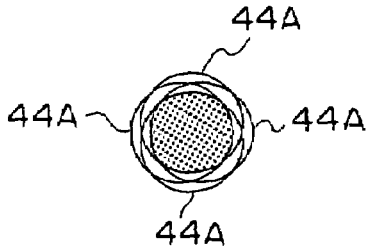
FIG. 3D is an enlarged view showing a dot shown in FIG. 3B.

In the example illustrated in FIG. 3B, four dots are injected at one position, as illustrated in FIG. 3D, and then, the recording medium P is transported by a distance corresponding to the total diameter of the three dots. Thereafter, the injection of four dots from different nozzles is repeated in the same manner, thereby detecting the ejection from all of the nozzles.

Alternatively, the recording medium is transported per dot, so that the dots are printed on a slant line, as illustrated in FIG. 3C. In this manner, there may be used a system for detecting an omitted dot.

Figure 4A:
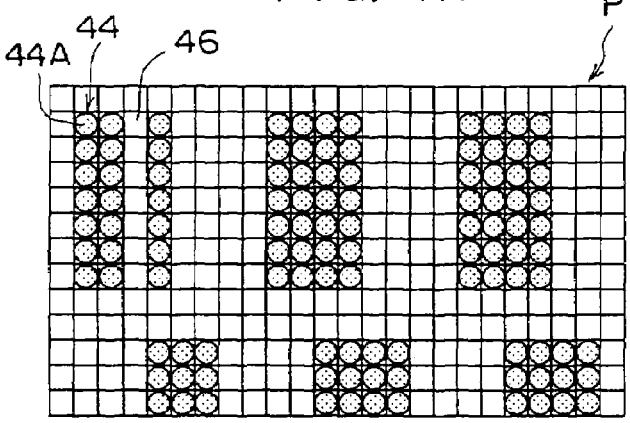
FIG. 4A is an enlarged view showing a further non-ejection detecting pattern.

Otherwise, FIG. 4A illustrates a pattern formed when the ink droplets are simultaneously injected from the plurality of nozzles (the continuous four nozzles in a lateral direction in FIG. 4A, herein) at a normal feeding speed. On the basis of the pattern, non-ejection is detected.

Here, if there is a non-ejection nozzle which cannot eject the ink, the ink droplets are simultaneously injected from the plurality of nozzles at a decreased recording medium feeding speed, and thus, it is determined as to whether or not the number of printing blanks caused by the non-ejection is a standard value or more (a blank region 46 in FIG. 4A, that is, a white line extending in a vertical direction in FIG. 4A).

Figure 4B:
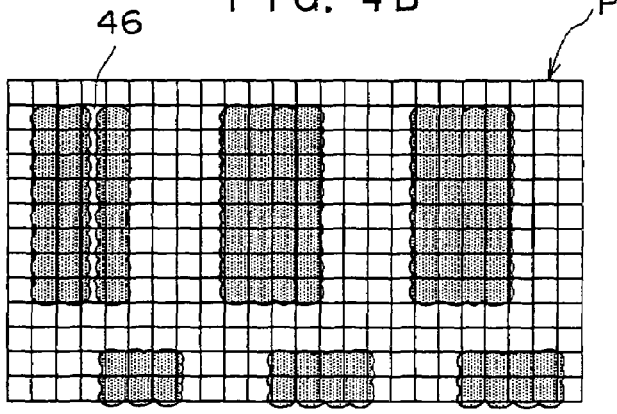
FIG. 4B is an enlarged view showing the non-ejection detecting pattern in the case where a feednig speed is reduced.
Figure 4C:
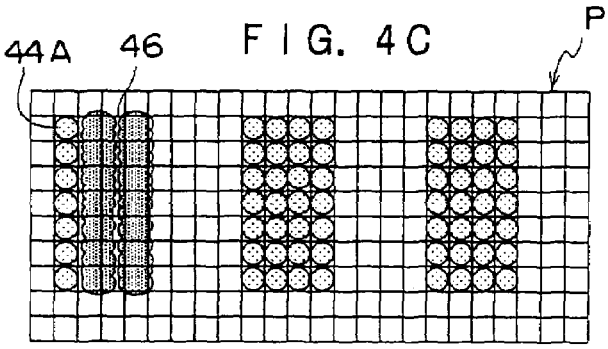
FIG. 4C is an enlarged view showing normal printing in the case where the feeding speed is halved.
Figure 4D:
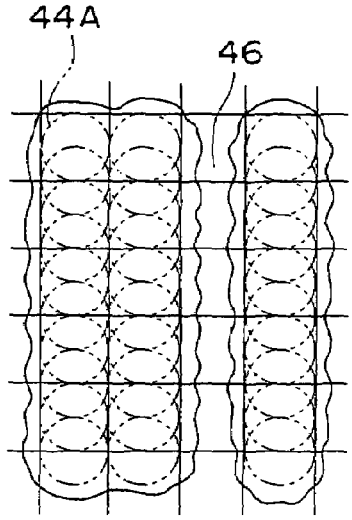
FIG. 4D is an enlarged view showing a dot shown in FIG. 4C.

For example, in the case where the width of the blank region 46 is less than a half dot (caused by the ooziness of the ink) by setting the recording medium feeding speed to a half of the normal speed, as illustrated in FIG. 4B, the printing operation is performed at a half of the normal recording medium feeding speed. In this case, printing data formed by nozzles other than adjacent nozzles on both sides of the non-ejection nozzle is printed every one dot in the transportation direction of a recording medium by data processing. The adjacent nozzles on both sides of the non-ejection nozzle perform the printing operation with twice the quantity of data, so that the ink oozes so as to increase the diameter of the dot, as illustrated in FIGS. 4C and 4D, thereby making the blank region 46 inconspicuous. Consequently, an image can be formed in the same manner as the case of the printing operation at the normal speed.

Incidentally, although the head unit (i.e., the nozzle) of a fixed type is used in the ink jet recording apparatus 10 in the present embodiment, there may be used a head of a type which is moved in a direction perpendicular to the transportation direction of a recording medium while the recording medium P is transported.

In the first embodiment, the detection of the non-ejection of the colored ink is explained. In the detection of a state that a treatment liquid (for example, a liquid for preventing any ooziness of the ink or a liquid for speedily drying the ink) is not ejected, it cannot be determined as to whether or not the treatment liquid is normally ejected when the treatment liquid is injected onto the normal recording medium P for a printing operation.

In view of this, in order to achieve the determination of adhesion of the treatment liquid, a recording medium special for ejection detection is used in place of the normal recording medium P.

For example, a treatment liquid, which causes a chemical reaction on a recording medium due to reaction with the normal ink, is reverse in pH to the normal ink. That is to say, a change in color of the recording medium special for ejection detection is detected by utilizing that the treatment liquid is not neutral and using a litmus paper as the recording medium special for ejection detection, thereby detecting the non-ejection.

If the line sensor 34 observes the change in color of the litmus paper by utilizing that a blue litmus paper is changed to be red due to the adhesion of the treatment liquid (acidic), the non-ejection of the treatment liquid can be detected.

Incidentally, in the case where the color is changed without any increase in concentration of the recording medium due to the adhesion of the treatment liquid, the line sensor 34 is used for the color ink; in contrast, the line sensor 34 is used for the monochromatic ink in the case where the concentration becomes higher.

Here, because it becomes difficult to determine the non-ejection of the treatment liquid at the smaller dot diameter in the case of the high resolution, the detection becomes easy by increasing the quantity of treatment liquid per unit area by decreasing the recording medium feedng speed in the same manner as the ink.

Moreover, the litmus paper can be used also in the case of the normal ink. For example, in the case of alkaline ink (i.e., the yellow ink), a (red) litmus paper capable of detecting alkalescence may be used, and thus, the line sensor may detect that the litmus paper is changed to be blue due to the adhesion of the ink.

Although the litmus paper is used as the recording medium special for ejection detection in the present embodiment, the invention is not limited to this. Examples of recording medium capable of detecting acid material include a potassium iodide starch paper whose color changes caused by oxide, a pH examination recording medium capable of measuring a pH, a universal examination recording medium and a whole resin examination recording medium. There can be used any recording medium, which is developed in color, is changed in color or is increased in concentration due to the adhesion of the treatment liquid or the ink.

Additionally, the non-ejection detecting pattern in the above-described embodiment can be used.

Here, although the non-ejection detecting pattern has been detected by the line sensor 34 in the above-described embodiment, it may be detected visually.

In the ink jet injection condition detecting method according to the invention, the ink droplets are ejected at one and the same position the plurality of times in the state in which the transportation of the recording medium is stopped, thereby printing the detecting pattern.

Incidentally, the detecting pattern may be detected by an optical sensor or visually.

In the case of the low concentration ink such as the yellow ink, the detection sensitivity is degraded in comparison with the high concentration ink such as the black ink. According to the invention, the ink adhesion quantity per unit area on the recording medium can be increased by ejecting the ink droplets at one and the same position the plurality of times in the state in which the transportation of the recording medium is stopped. Thus, the concentration of the detecting pattern becomes higher, thereby preventing any degradation of the detection sensitivity.

In the ink jet injection condition detecting method according to the invention, the detecting pattern is formed on the recording medium by ejecting the ink from the nozzle while the recording medium is transported. The detecting pattern having the plurality of ink dots arranged in the transportation direction of a recording medium is formed on the recording medium by ejecting the ink droplets at, for example, the predetermined intervals from the nozzle, thereby detecting the ejection of the ink from the nozzle.

Incidentally, the detecting pattern may be detected by an optical sensor or visually.

Here, in the case of the low concentration ink such as the yellow ink, the detection sensitivity is degraded in comparison with the high concentration ink such as the black ink. According to the invention, the ink droplets can be superimposed one on another on the recording medium by decreasing the recording medium feednig speed less than that in the normal printing operation. As a consequence, the ink adhesion quantity per unit area on the recording medium can be increased, and thus, the concentration of the detecting pattern becomes higher, thereby preventing any degradation of the detection sensitivity.

Here, the nozzle may be fixed, or it may be moved in the direction perpendicular to the transportation direction of a recording medium while the recording medium is transported.

In the ink jet recording apparatus, the treatment liquid can be ejected in the same manner as the ink by using the treatment liquid in place of the ink.

Even if the colorless treatment liquid such as the ink is used in the above-described ink jet injection condition detecting method, the ejection condition can be detected. In other words, when the treatment liquid adheres to the examination recording medium, a portion, to which the treatment liquid adheres, is changed in color. Therefore, the ejection condition of the treatment liquid can be detected by detecting the change in color on the examination recording medium. In this case, for the sake of ready detection, the color may be changed to be deep owing to the adhesion of the treatment liquid.

Incidentally, the detecting pattern may be detected by an optical sensor or visually.

Examples of examination recording medium whose color changes owing to the adhesion of the treatment liquid include the litmus paper. In this case, the treatment liquid is not neutral, that is, alkaline or acidic according to the litmus paper.

The examination recording medium may incorporate therein a component whose color changes by reaction with a specific component contained in the treatment liquid.

In the ink jet recording apparatus, when the detecting pattern is formed on the recording medium, the controller controls driving of the recording medium feeding unit and the nozzle in such a manner as to eject the ink droplets at one and the same position the plurality of times in the state in which the transportation of the recording medium is stopped.

In the case of the low concentration ink such as the yellow ink, the detection sensitivity is degraded in comparison with the high concentration ink such as the black ink. According to the invention, the ink adhesion quantity per unit area on the recording medium can be increased by ejecting the ink droplets at one and the same position the plurality of times in the state in which the transportation of the recording medium is stopped, and thus, the concentration of the detecting pattern becomes higher, thereby preventing any degradation of the detection sensitivity.

Incidentally, the detecting pattern may be detected by an optical sensor or visually.

In the ink jet recording apparatus, the detecting pattern is formed on the recording medium by ejecting the ink from the nozzle while the recording medium is transported. The detecting pattern having the plurality of ink dots arranged in the transportation direction of a recording medium is formed on the recording medium by ejecting the ink droplets at, for example, the predetermined intervals from the nozzle, thereby detecting the ejection of the ink from the nozzle.

Here, when the detecting pattern is formed on the recording medium, the controller controls driving of the recording medium feeding unit in such a manner as to decrease the recording medium feeding speed less than that in the normal printing operation.

In the case of the low concentration ink such as the yellow ink, the detection sensitivity is degraded in comparison with the high concentration ink such as the black ink. According to the invention, the ink droplets can be superimposed one on another on the recording medium by decreasing the recording medium feeding speed less than that in the normal printing operation. As a consequence, the ink adhesion quantity per unit area on the recording medium can be increased, and thus, the concentration of the detecting pattern becomes higher, thereby preventing any degradation of the detection sensitivity.

Incidentally, the nozzle may be fixed, or it may be moved in the direction perpendicular to the feeding direction of a recording medium while the recording medium is transported.

Moreover, the detecting pattern may be detected by an optical sensor or visually.

As described above, the ink jet injection condition detecting method according to the invention can produce the excellent effect of the secure examination of the ejection from the nozzle irrespective of the kind of ink.

Furthermore, the ink jet injection condition detecting method according to the invention can produce the excellent effect of the secure examination of the ejection from the nozzle even if the colorless treatment liquid such as the ink is used.

Additionally, the ink jet recording apparatus according to the invention can produce the excellent effect of the secure examination of the ejection from the nozzle irrespective of the kind of ink.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method of forming a detecting pattern to identify a malfunctioning droplet injecting element, the method comprising:

setting a transporting speed of a recording medium lower than a speed during a normal printing operation, when the detecting pattern is formed.

2. An ink jet recording apparatus capable of detecting an ink injection condition by ejecting ink droplets so as to form a detecting pattern on a recording medium, the ink jet recording apparatus comprising:

a feeding unit for feeding the recording medium;

a ejecting element for ejecting the ink droplets onto the recording medium; and a controller for controlling driving of at least the feeding unit and the ejecting element;

wherein the controller controls driving of the feeding unit and the ejecting element in such a manner as to eject the ink droplets at almost identical position in a state in which the transportation of the recording medium is stopped, when the detecting pattern is formed.

3. An ink jet recording apparatus capable of detecting an ink injection condition by ejecting ink droplets onto a recording medium so as to form a detecting pattern on the recording medium, the ink jet recording apparatus comprising:

a feeding unit for feeding the recording medium;

a ejecting element for ejecting the ink droplets onto the recording medium; and a controller for controlling driving of at least the feeding unit and the ejecting element;

wherein the controller controls driving of the feeding unit in such a manner that, when the detecting pattern is formed, a feeding speed of the recording medium is made slower than a speed during a normal printing operation.

* * * * *